US006737392B1

(12) United States Patent
Keys et al.

(10) Patent No.: US 6,737,392 B1
(45) Date of Patent: May 18, 2004

(54) MDEA ESTER QUATS WITH HIGH CONTENT OF MONOESTER IN BLENDS WITH TEA ESTER QUATS

(75) Inventors: Robert O. Keys, Columbus, OH (US); Christopher J. Toney, Columbus, OH (US); David L. Gefvert, Chester, VA (US)

(73) Assignee: Goldschmidt Chemical Corporation, Hopewell, VA (US)

( * ) Notice: Subject to any disclaimer, the term of this patent is extended or adjusted under 35 U.S.C. 154(b) by 0 days.

(21) Appl. No.: 10/458,912

(22) Filed: Jun. 11, 2003

(51) Int. Cl.[7] ..... C11D 1/62

(52) U.S. Cl. ..... 510/330; 510/276; 510/287; 510/329; 510/330; 510/394; 510/504; 510/515; 510/322; 510/327

(58) Field of Search ..... 510/276, 287, 510/329, 330, 394, 504, 515, 322, 327

(56) References Cited

U.S. PATENT DOCUMENTS

| | | | | | |
|---|---|---|---|---|---|
| 5,747,108 | A | * | 5/1998 | Farooq et al. | 427/242 |
| 5,750,490 | A | * | 5/1998 | Wilsch-Irrgang et al. | 510/504 |
| 5,783,534 | A | * | 7/1998 | Wahle et al. | 510/124 |
| 5,880,086 | A | * | 3/1999 | Weinelt et al. | 510/504 |
| 5,961,966 | A | * | 10/1999 | Abend et al. | 424/70.28 |
| 6,432,895 | B1 | * | 8/2002 | Bigorra et al. | 510/123 |
| 6,465,419 | B1 | * | 10/2002 | Bermejo Oses et al. | 510/515 |
| 6,562,780 | B2 | * | 5/2003 | Bermejo et al. | 510/515 |

* cited by examiner

*Primary Examiner*—Charles Boyer
(74) *Attorney, Agent, or Firm*—Scully, Scott, Murphy & Presser

(57) ABSTRACT

A fabric softener composition in which a blend of high mono alkyl MDEA and TEA ester quats is provided. The fabric softener composition includes a blend of from about 15 to about 65%, by weight of the total blend, of a triethanol amine ester quat and from about 35 to about 85%, by weight of the total blend, of a methyl diethanol amine ester quat having a mono alkyl ester quat level of about 10% or greater.

24 Claims, No Drawings

MDEA ESTER QUATS WITH HIGH CONTENT OF MONOESTER IN BLENDS WITH TEA ESTER QUATS

FIELD OF THE INVENTION

The present invention relates to fabric softener compositions, and more particularly to a fabric softener composition that comprises a blend of a methyl diethanol amine (MDEA) ester quaternary (quat) and a triethanol amine (TEA) ester quaternary (quat), wherein the MDEA ester quat has a high content of monoester. The fabric softener composition of the present invention provides improved softening performance as compared with either of the individual components alone. Moreover, the fabric softener composition of the present invention is capable of providing a high-solids formulation that forms stable dispersions that maintain long term stability.

BACKGROUND OF THE INVENTION

In North America, methyl diethanol amine (MDEA) ester quats are generally used as softening agents in various fabric softener formulations. MDEA ester quats are typically made by reacting various fatty acids such as a tallow fatty acid with MDEA; MDEA, which is also known as 2,2'-methyliminodiethanol, has the basic structural formula $(HOCH_2CH_2)_2NCH_3$.

The MDEA ester quats are normally made so that the products contain low levels of monoester (on the order of about 4 to about 7% solids) for the fabric softener market because MDEA ester quats having a high monoester content are reported to be hard to formulate and they give thick gelatinuous formulations at high solids over 12%. Most formulations employed in the North American market are ultra products that are over 24% solids and even as high as 28% solids.

Triethanol amine (TEA) ester quats are the generic ester quats that are used in Europe, but TEA ester quats are not used much in the North America market because TEA ester quats do not soften well under Northern American washing conditions. The reasons for this is because of residual anionics remaining in the rinse cycle due to the single rinse cycles employed in typical North American top loading washing machines. Prior art TEA ester quats can only be formulated to about 18% solids due to their chemistry.

The raw materials used in making TEA quats arc lower in cost than MDEA ester quats and thus have a cost driver if TEA ester quats could be used in the production of fabric softener formulations in North American products.

Attempts have been made in the prior art to provide formulations in which MDEA and TEA ester quats are both present. In such formulations, a mixture of two different amines, i.e., MDEA/TEA, is first provided. The amine mixture is then esterified in the presence of a fatty acid and thereafter the esterification reaction product is quaternized. Such a formulation is disclosed, for example, in DE 196 42 038 C1 assigned to Henkel KGAA (hereinafter DE '038).

Specifically, DE '038 discloses quaternary esters that are obtained by esterifying MDEA/TEA mixtures (weight ratio= 20-1:80–99) with fatty acids and then quaternizing the reaction product with an alkylating agent using known quaternization processes. The ester quats disclosed in DE '038 are said to have a sufficiently low and storage stable viscosity which makes the ester quats highly suitable for use in cosmetics and brighteners.

In DE '038, an esterification product of a partially hydrogenated $C_{16-18}$ tallow fatty acid and a MDEA/TEA mixture is described for a fabric softener. In particular, DE '038 discloses that the MDEA/TEA ratio on the order of 15% MDEA and 85% TEA makes a superior softener. Manufacturing quats in the manner disclosed in DE '038 does not allow for the controlled production of MDEA having a high monoester content.

In view of the state of the prior art mentioned above, there is a need for providing a fabric softener composition that incorporates both MDEA and TEA ester quats into a single formulation in which the use of an amine pre-mixture, i.e., a mixture of MDEA and TEA which is formed prior to esterification and quaternization, is avoided.

SUMMARY OF THE INVENTION

The present invention relates to a fabric softener composition in which a blend of MDEA having a high monoester content and TEA ester quats is employed. Throughout the remaining portions of the application, the term "high mono alkyl MDEA ester quat" is used to describe the MDEA having a high monoester content. It should be understood that the two terms are interchangeably used in the present application to describe a methyl diethanol amine ester quat having a mono alkyl ester quat level of about 10% or greater. It has been found by the present applicants that a formulated blend of a high mono alkyl MDEA ester quat, i.e., MDEA having a high monoester content, and a TEA ester quat provides improved softening performance that is better than that obtained with either of the individual components (standard low mono alkyl MDEA ester quats or standard TEA ester quats).

In addition, the applicants have determined that even though the individual ester quat products can be formulated to 12 to 18% solids, when the two ester quats are blended together, as in the present invention, the blend may have a solids content about 25% or higher. Moreover, the inventive blend of a high mono alkyl MDEA ester quat, i.e., MDEA having a high monoester content, and a TEA ester quat forms a stable dispersion that maintains long-term stability.

The fabric softener composition of the present invention has a definite synergism that enables the use of less expensive raw materials to provide improved softening results. The fabric softener composition of the present invention may further contain other quats blended with the initial blend of high mono alkyl MDEA ester quat, i.e., MDEA having a high monoester content, and TEA ester quat that provides even further softening improvements as well as stable formulations.

Normally formulations containing commercially available di tallow dimethyl ammonium chloride are known to thicken over time when they are formulated into a composition of high solids with TEA or MDEA ester quats. In the present invention, the high mono alkyl MDEA ester quat, i.e., MDEA having a high monoester content, and TEA ester quat compositional blend permits the formulation of a thermally stable high-solids product even when other conventional quats are formulated therein.

The fabric softener composition of the present invention, i.e., the blend of high mono alkyl MDEA ester quat (MDEA having a high monoester content) and TEA ester quat, can be dispersed in warm water to form high solids formulations that are stable under commercial conditions. The term "high solids" as used throughout the instant application denotes a solids content of about 20% or higher.

In broad terms, the present invention relates to a fabric softener composition that comprises a blend of from about 15 to about 65%, by weight of the total blend, of a triethanol amine ester quat and from about 35 to about 85%, by weight of the total blend, of a methyl diethanol amine ester quat, said methyl diethanol amine ester quat having a mono alkyl ester quat level of about 10% or greater. Throughout this application the term "high mono alkyl MDEA ester quat" is used to describe the methyl diethanol amine ester quat having a mono alkyl ester (i.e., monoester) quat level of about 10% or greater.

The fabric softener composition of the present invention may contain more than one high mono alkyl MDEA ester quat and more than one TEA ester quat blended together. Other ingredients/components that are typically present in a fabric softener composition may or may not be present in the inventive TEA/MDEA ester quat blend. In some embodiments of the present invention, the blend consists essentially of the TEA ester quat and the MDEA ester quat; water can be used in conjunction with the TEA/MDEA blend since it would not materially affect the softening properties of the blend. Blends of only TEA/MDEA ester quat (and optionally water) provide improved softness without the need of other fabric softener ingredients/components.

The fabric softener composition of the present invention may also contain other quats blended therein. Other quats that may be added to the blended formulation of the present invention include, but are not limited to: di tallow dimethyl ammonium chloride, di tallow imidazolinium methyl sulfate and amido amine based methyl sulfate quats.

The present invention also provides a liquid fabric softener composition which comprises a blend of from about 15 to about 65%, by weight of the total blend, of a triethanol amine ester quat and from about 35 to about 85%, by weight of the total blend, of a methyl diethanol amine ester quat, said methyl diethanol amine ester quat having a mono alkyl ester quat level of about 10% or greater; and water.

DETAILED DESCRIPTION OF THE INVENTION

As stated above, the present invention provides a fabric softener composition, solid and liquid, which includes at least a blend of from about 15 to about 65%, by weight of the total blend, of a triethanol amine (TEA) ester quat and from about 35 to about 85% by weight of the total blend, of a methyl diethanol amine (MDEA) ester quat, said methyl diethanol amine ester quat having a mono alkyl ester quat level of about 10% or greater. The MDEA ester quat of the present invention may be referred to herein as a "high mono alkyl MDEA ester quat" or "MDEA ester quat with a high content of monoester" since it contains 10% or more of a mono alkyl ester quat. The liquid fabric softener composition includes water.

More preferably, the blend of the present invention comprises from about 25 to about 50%, by weight of the total blend, of a triethanol amine ester quat and from about 50 to about 75%, by weight of the total blend, of a high mono alkyl methyl diethanol amine ester quat. Even more preferably, the blend of the present invention comprises from about 30 to about 45%, by weight of the total blend, of a triethanol amine ester quat and from about 55 to about 70%, by weight of the total blend, of a high mono alkyl methyl diethanol amine ester quat. Most preferably, the blend of the present invention comprises from about 35 to about 40%, by weight of the total blend, of a triethanol amine ester quat and from about 60 to about 65%, by weight of the total blend, of a high mono alkyl methyl diethanol amine ester quat.

As stated above, the high mono alkyl MDEA ester quat, i.e., MDEA ester quat with a high content of monoester, of the present invention contains about 10% or greater of the corresponding mono alkyl ester quat present therein. The mono alkyl ester component, i.e., monoester, is a bi-product that is typically formed during the synthesis of the MDEA ester quat. In the prior art, it is known to use MDEA ester quats that have a low level of mono alkyl ester component. In the present invention, however, the MDEA ester quat employed has a high mono alkyl ester component, i.e., monoester, that is within the range mentioned above. More preferably, the high mono alkyl MDEA ester quat of the present invention contains from about 15 to about 50% of the corresponding mono alkyl ester component. Even more preferably, the level of mono alkyl ester component present in the MDEA ester quat is from about 20 to about 35%.

The term "TEA ester quat" is used in the present invention to denote an ester quat having the following structural formula:

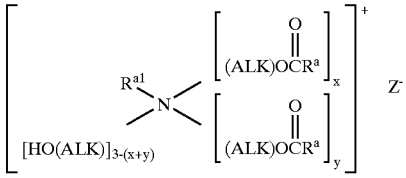

in which each $R^a$ is individually selected from the group consisting of straight or branched chain, optionally substituted alkyl groups having from 11 to 23 carbon atoms; $R^{a1}$ is the alkyl or aralkyl moiety of the alkylating agent, i.e., a $C_1$–$C_4$, preferably $C_1$–$C_3$, straight or branched alkyl or a $C_7$–$C_{10}$ aralkyl; ALK is an alkylene having from 2 to about 6 carbon atoms; $Z^-$ is a softener compatible anion such as, for example, a halogen, $CH_3SO_4^-$ or $C_2H_5SO_4^-$; and x+y= the mole ratio of fatty acid to triethanol amine, i.e., 1.2 to 2.5. More preferably, each $R^a$ is individually selected from the group consisting of straight or branched chain, optionally substituted alkyl groups having from 11–21 carbon atoms; $R_{a1}$ is methlyl; ALK is an $C_2H_4$; and $Z^-$ is an anion such as $Cl^-$, $CH_3SO_4^-$, $C_2H_5SO_4^-$, and other like softening anions.

The TEA ester quat is prepared using conventional procedures that are well known to those skilled in the art. For example, the TEA ester quat may be prepared by reacting at least one $C_{12}$–$C_{22}$ fatty acid, the hydrogenation product thereof, or a mixture of such acids, with a triethanol amine, optionally in the presence of an acid catalyst, wherein the ratio of fatty acid to triethanol amine is from about 1.2–2.5. The resultant esteramine reaction product is subsequently quaternized to obtain the TEA ester quat of the present invention.

The fatty acid is preferably a $C_{16}$–$C_{22}$ acid containing a degree of unsaturation such that the iodine value ("IV") is in the range of from about 0–150, preferably, from about 0–70, and more preferably in the range of 0–50. Preferred fatty acids include, but are not limited to: oleic, palmitic, erucic, eicosanic and mixtures thereof. Soy, tallow, partially hydrogenated tallow, palm, palm kernel, rape seed, lard, coconut, canola, safflower, corn, rice, tall oil and mixtures thereof and the like are typical sources for fatty acids which can be employed in the present invention. The fatty acids can be partially or fully hydrogenated and blends of the above-mentioned oils or other naturally occurring oils or triglycerides may be used.

Partial hydrogenation or full hydrogenation can be employed, if required, to minimize the polyunsaturate levels in order to improve the stability (e.g., odor, color, etc.) of the final product.

The molar ratio of fatty acid to triethanol amine is generally in the range of from about 1.2 to 2.5, preferably from about 1.4–2.0, and more preferably, in the range of from about 1.6–1.9. Examples of acid catalysts that may be employed in the present process include, but are not limited to: acid catalysts such as sulphonic acid, phosphorous acid, p-toluene sulphonic acid, methane sulphonic acid, oxalic acid, hypophosphorous acid or an acceptable Lewis acid in an amount of 500–3000 ppm based on the amount of fatty acid charge. A preferred acid catalyst is hypophosphorous acid. Typically, 0.02–0.2% by weight, and more preferably 0.1 to 0.15% by weight of acid catalyst, based on the weight of fatty acid may be employed in the present process.

The esterification of fatty acids with triethanol amine is carried out at a temperature of from about 170° C.–250° C. until the reaction product has an acid value of below 5. After the esterification, the crude product is reacted with an alkylating agent in order to obtain the quaternary ammonium product. Preferred alkylating agents include $C_1$–$C_4$, more preferably $C_1$–$C_3$, straight or branched chain alkyl halides, phosphates, carbonates, or sulfates, $C_7$–$C_{10}$ aralkyl halides, phosphates or sulfates, and mixtures thereof. Examples of preferred alkylating agents employed in the present invention include, but are not limited to: methyl chloride, benzyl chloride, diethyl sulfate, dimethyl carbonate, trimethyl phosphate, dimethyl sulfate or mixtures thereof. Choosing the type and amount of alkylating agent employed is well within the skill of one in the art.

The term "MDEA ester quat" is used in the present invention to denote an ester quat having the following structural formula:

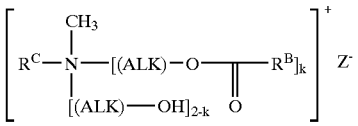

in which $R^B$ is individually selected from the group consisting of straight or branched chain, optionally substituted alkyl groups having from 11 to 23 carbon atoms; ALK is an alkylene having from 2 to about 6 carbon atoms; k= the mole ratio of fatty acid to MDEA, i.e., 1.2 to 1.7; $R^c$ is a $C_1$–$C_4$, preferably a $C_1$–$C_3$, alkyl, or a $C_7$–$C_{10}$ aralkyl; and $Z^-$ is a softener compatible anion such as a halogen, $CH_3SO_4^-$ or $C_2H_5SO_4^-$. Preferably, $R^B$ is individually selected from the group consisting of straight or branched chain, optionally substituted alkyl groups having from 11–21 carbon atoms; ALK is $C_2H_4$; $R^c$ is methyl; and $Z^-$ is an anion such as $Cl^-$, $CH_3SO_4^-$, and $C_2H_5SO_4^-$.

The MDEA ester quat is prepared using a procedure in which a high mono alkyl ester component, e.g., monoester, is obtained. For example, the MDEA ester quat may be prepared by reacting at least one $C_{12}$–$C_{22}$ fatty acid, the hydrogenation product thereof, or a mixture of such acids, with methyl diethanol amine optionally, in the presence of an acid catalyst, wherein the ratio of fatty acid to diethanol amine is from about 1.2–1.7. The resultant esteramine reaction product is subsequently quaternized to obtain the MDEA ester quat of the present invention.

The fatty acid is preferably a $C_{16}$–$C_{22}$ acid containing a degree of unsaturation such that the iodine value ("IV") is in the range of from about 0–150, preferably, from about 0–70, and more preferably in the range of 0–50. Preferred fatty acids include, but are not limited to: oleic, stearic palmitic, erucic, eicosanic and mixtures thereof. Soy, tallow, partially hydrogenated tallow, palm, palm kernel, rape seed, lard, coconut, canola, safflower, corn, rice, tall oil and mixtures thereof and the like are typical sources for fatty acids which can be employed in the present invention. The fatty acids can be partially or fully hydrogenated and blends of the above-mentioned oils or other naturally occurring oils or triglycerides may be used.

Partial hydrogenation or full hydrogenation can be employed, if required, to minimize the polyunsaturate levels in order to improve the stability (e.g., odor, color, etc.) of the final product.

The molar ratio of fatty acid to diethanol amine is generally in the range of from about 1.2 to 1.7, preferably from about 1.2–1.5, and more preferably, in the range of from about 1.2–1.35. The acid catalyst that may be used in the present process includes, but is not limited to: acid catalysts such as sulphonic acid, phosphorous acid, p-toluene sulphonic acid, methane sulphonic acid, oxalic acid, hypophosphorous acid or an acceptable Lewis acid in an amount of 500–3000 ppm based on the amount of fatty acid charge. A preferred acid catalyst is hypophosphorous acid. Typically, 0.02–0.2% by weight, and more preferably 0.1 to 0.15% by weight of acid catalyst, based on the weight of fatty acid, may be employed in the present process.

The esterification of fatty acids with diethanol amine is carried out at a temperature of from about 170° C.–250° C. until the reaction product has an acid value of below 5. After the esterification, the crude product is reacted with an alkylating agent in order to obtain the quaternary ammonium product. Preferred alkylating agents include $C_1$–$C_4$, more preferably $C_1$–$C_3$, straight or branched chain alkyl halides, phosphates, carbonates, or sulfates, $C_7$–$C_{10}$ aralkyl halides, phosphates or sulfates, and mixtures thereof. Examples of preferred alkylating agents employed in the present invention include, but are not limited to: methyl chloride, benzyl chloride, diethyl sulfate, dimethyl carbonate, trimethyl phosphate, dimethyl sulfate or mixtures thereof. Choosing the type and amount of alkylating agent employed is well within the skill of one in the art.

Because of the synthesis employed in making the MDEA ester quat, a mono alkyl ester component, e.g., monoester, is typically present. In the present invention, the mono alkyl ester component is typically present in an amount of about 10% or greater.

As stated above, the fabric softener composition of the present invention includes a blend of at least one TEA ester quat and at least one high mono alkyl MDEA ester quat, i.e., MDEA ester quat with a high content of monoester. That is, the fabric softener composition of the present invention is a product that is obtained from blending the TEA ester quat with the high mono alkyl MDEA ester quat, i.e., MDEA ester quat with a high content of monoester. The present invention does not include a product in which an amine pre-mixture is first provided and thereafter the amine pre-mixture is esterified and quaternized.

The blending step of the present invention is carried out using procedures well known to those skilled in the art. In particular, the blending is carried out in an apparatus containing a stirrer. The individual ester quits ;ire added to the apparatus in any order and then stirring is initiated.

In accordance with the present invention, die blend comprises from about 15 to about 65%, by weight of the total blend, of a triethanol amine ester quat and from about 35 to about 85%, by weight of the total blend, of a high mono alkyl methyl diethanol amine ester quat, i.e., MDEA ester quat with a high content of monoester. More preferably, the blend of the present invention comprises from about 25 to about 50%, by weight of the total blend, of a triethanol amine ester quat and from about 50 to about 75%, by weight of the total blend, of a high mono alkyl methyl diethanol amine ester quat. Even more preferably, the blend of the present invention comprises from about 30 to about 45%, by weight of the total blend, of a triethanol amine ester quat and from about 55 to about 70%, by weight of the total blend, of a high mono alkyl methyl diethanol amine ester quat. Most preferably, the blend of the present invention comprises from about 35 to about 40%, by weight of the total blend, of a triethanol amine ester quat and from about 60 to about 65%, by weight of the total blend, of a high mono alkyl methyl diethanol amine ester quat.

The solid fabric softener blend of the present invention may be formulated into an aqueous, i.e., liquid, fabric softener, by adding water to the blended product. The amount of water added to the blended product is typically from about 250 to about 5000 ml per 100 grams of blended product. More preferably, the amount of water added is from about 900 to about 300 ml water per 100 grams of blended product.

The blended TEA/MDEA ester quat product of the present invention has a solids content, as measured by oven evaporation, of about 10 to about 30%. More preferably, the solids content of the blended product of the present invention is from about 20 to about 28%.

The blended product of the present invention may also include other quaternary ammonium compounds including di ester ammonium quaternaries, inadizolinum based quaternaries, and amido amine based quaternaries that arc well known to those skilled in the art. Examples of some optional quats that may preferably be employed in the present invention include, but are not limited to: di tallow dimethyl ammonium chloride, di tallow imidazaolium methyl sulfate, amido amine based quaternaries and the like thereof, including mixtures thereof.

The other quats may be added during or after the initial blending process. The amount of other quats that may be used in the present invention is from about 0 to about 60%, based on the total blend, with an amount of other optional quat of from about 0 to about 20% being more highly preferred.

The other quats employed in the present invention arc typically difficult to formulate into high-solids formulation. In the present invention, the blend of TEA/MDEA ester quats allows other quats to be used in a high-solids formulation.

The formulated blend of a high monoalkyl MDEA ester quat, i.e., MDEA ester quat with a high content of monoester, and a TEA ester quat provides improved softening performance that is better than that obtained with either of the individual components. In addition, the applicants have determined that even though the individual products can be formulated to 12 to 18% solids, when the two ester quats are blended together, as in the present invention, the blend may have a solids content about 25% or higher. Moreover, the inventive blend of a high mono alkyl MDEA ester quat, i.e., MDEA ester quat with a high content of monoester, and a TEA ester quat forms a stable dispersion that maintains long-term stability.

Although the stability of the fabric softening composition of the present invention is such that stabilizing cosurfactants are not required, they may nevertheless be included along with a wide variety of other optional ingredients. A non-limiting description of some of the optional ingredients that may be employed in the fabric softening composition of the present invention is provided below. These optional ingredients may be added before, or after, the initial blending process.

I) Viscosity/dispersibility Aids

As mentioned above, relatively concentrated compositions of the inventive blend can be prepared that are stable, without the addition of concentration aids. However, the compositions of the present invention may require organic and/or inorganic concentration aids to go to even higher concentrations and/or to meet higher stability standards depending on the other ingredients. These concentration aids, which are typically viscosity modifiers, may be needed, or preferred, for ensuring stability under extreme conditions when particular softener active levels in relation to IV are present.

Surfactant Concentration Aids

Surfactant concentration aids typically fall into four categories:

(1) mono long chain alkyl cationic surfactants;

(2) nonionic surfactants;

(3) amine oxides; and (4) fatty acids.

Mixtures of the aforementioned surfactant concentration aids can, of course, also be employed.

(1) Mono-long Chain Alkyl Cationic Surfactants

Preferred mono-long chain alkyl or ester based water-soluble cationic surfactants generally fall within the scope of the following general formula:

$$[R^2N^+(R)_3]X^-$$

wherein the $R^2$ group is $C_8$–$C_{22}$ hydrocarbon group, preferably $C_{12}$–$C_{18}$ alkyl group or the corresponding ester linkage interrupted group with a short chain alkylene ($C_1$–$C_6$) group between the ester linkage and the N, and having a similar hydrocarbon group. Each R is a $C_1$–$C_6$ unsubstituted or substituted alkyl (e.g., by hydroxy) or hydrogen, preferably methyl, and the counterion X— is a softener compatible anion such as, for example, chloride, bromide, methyl sulfate, etc.

The cationic surfactants, if present, are usually added to solid compositions at a level of from 0% to about 15%, preferably from about 3% to about 15%, more preferably from about 5% to about 15%. In liquid compositions they are usually employed at level of from 0% to about 15%, preferably from about 0.5% to about 10%. In general, the total amount single-long-chain cationic surfactant is added in an amount effective to obtain a stable composition. The foregoing levels represent the amount of the single-long-chain-alkyl cationic surfactant that is added to the composition of the present invention.

The long chain group $R^2$, of the single-long-chain-alkyl cationic surfactant generally contains an alkylene group having from about 10 to about 22 carbon atoms, preferably from about 12 to about 16 carbon atoms for solid compositions, and preferably from about 12 to about 18 carbon atoms for liquid compositions.

This $R^2$ group can be attached to the cationic nitrogen atom through a group containing one, or more, ester, amide, ether, amine, etc., preferably ester, linking groups which can be desirable for increased hydrophilicity, biodegradability, etc. Such linking groups are preferably within about three carbon atoms of the nitrogen atom. Suitable biodegradable single-long-chain alkyl cationic surfactants containing an ester linkage in the long chain are described in U.S. Pat. No. 4,840,738, which is incorporated herein by reference. If the corresponding, non-quaternary amines are used, any acid (preferable a mineral or polycarboxylic acid) which is added to keep the ester groups stable will also keep the amine protonated in the compositions and preferably during the rinse so that the amine has a cationic group. The composition is buffered (pH from about 2 to about 5, preferably from about 2 to about 4) to maintain an appropriate, effective charge density in the aqueous liquid concentrate product and upon further dilution e.g., to form a less concentrated product and/or upon addition to the rinse cycle of a laundry process.

The main function of the water-soluble cationic surfactant is to lower the viscosity and/or increase the dispersibility of the fabric softener composition of the present invention and it is not, therefore, essential that the cationic surfactant itself have substantial softening properties, although this may be the case. Also, surfactants having only a single long alkyl chain, presumably because they have greater solubility in water, can protect the fabric softener composition of the present invention from interacting with anionic surfactants and/or detergent builders that are carried over into the rinse.

Other cationic materials with ring structures such as alkyl imidazoline, imidazolimium, pyridine, and pyridinium salts having a single $C_{12}$–$C_{30}$ alkyl chain can also be used. Some alkyl imidazolinium salts useful in the present invention have the general formula:

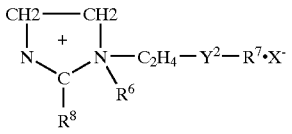

wherein $Y^2$ is —C(O)—)—, —O—(O)C—, —C(O)—N($R^5$), or —N($R^5$)—C(O)— in which $R^5$ is hydrogen or a $C_1$–$C_4$ alkyl radical; $R^6$ is a $C_1$–$C_4$ alkyl radical; $R^7$ and $R^8$ are each independently selected from R and $R^2$ as defined hereinbefore for the single-long-chain cationic surfactant with only one being $R^2$.

Some alkyl pyridinium salts useful in the present invention have the general formula:

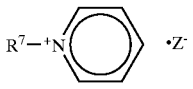

wherein $R^2$ and $X^-$ are as defined above. A typical material of this type is cetyl pyridinium chloride.

(2) Nonionic Surfactants—Alkoxylated Materials.

Nonionic surfactants suitable as viscosity/dispersibility modifiers include the addition products of ethylene and/or propylene oxide with fatty alcohols, fatty acids, fatty amines, etc. Any of the alkoxylated materials hereinafter described can be used as the nonionic surfactant. In general terms, the nonionics herein can be employed in solid compositions at a level of from about 5% to about 20%, preferably from about 8% to about 15, and in liquid compositions at a level of from 0% to about 5%, preferably from about 0.1% to about 5%, more preferably from about 0.2% to about 3%.

Suitable water-soluble nonionic surfactants generally fall within the scope of the following general formula:

$$R^2—Y—(C_2H_4O)_z—C_2H_4OH$$

wherein $R^2$ for both solid and liquid compositions is selected from the group consisting of primary, secondary and branched chain alkenyl hydrocarbyl groups; and primary, secondary and branched chain alkyl- and alkenyl-substituted phenolic hydrocarbyl groups; said hydrocarbyl groups having a hydrocarbyl chain length of from about 8 to about 20, preferably from about 10 to about 18 carbon atoms. More preferably the hydrocarbyl chain length for liquid compositions is from about 16 to about 18 carbon atoms and for solid compositions from about 10 to about 14 carbon atoms. In the general formula for the ethoxylated nonionic surfactants herein, Y is typically —O—, —C(O)—, —C(O)N(R)—, or —C(O)N(R)R—, wherein R, when present, has the meanings given hereinbefore, and/or R can be hydrogen, and z is at least about 8, preferably at least about 10–11. Performance, and usually stability of the softener composition decrease when fewer ethoxylate groups are present.

The nonionic surfactants herein are characterized by an HLB (hydrophilic-lipophilic balance) of from about 7 to about 20, preferably from about 8 to about 15. By defining $R^2$ and the number of ethoxylate groups, the HLB of the Surfactant is, for the most part, determined. However, it is preferred that for concentrated liquid compositions, the nonionic surfactants contain relatively long chain $R^2$ groups and are relatively highly ethoxylated. While shorter alkyl chain surfactants having short ethoxylated groups may possess the requisite HLB, they are not as effective.

Nonionic surfactants that may be employed in the present invention include, but are not limited: in the examples, the number of ethoxyl groups in the molecule (EO) is defined by an integer.

(i) Straight-chain, Primary Alcohol Alkoxylates

The deca-, undeca-, dodeca-, tetradeca-, and pentadeca-ethoxylates of n-hexadecanol, and n-octadecanol having an HLB within the preferred range are useful as viscosity/dispersibility modifiers of the context of the present invention. Preferred examples of ethoxylated primary alcohols useful herein include, but arc not limited to: n-$C_{18}$EO(10) and n-$C_{10}$EO(11). The ethoxylates of mixed natural or synthetic alcohols in the "tallow" chain length range arc also useful herein. Specific examples of such materials include tallow alcohol-EO(11), tallow alcohol-EO(18), and tallow alcohol-EO(25).

(ii) Straight-chain, Secondary Alcohol Alkoxylates

The deca-, undeca-, dodeca-, tetradeca-, pentadeca-, octadeca-, and nonadeca-ethoxylates of 3-hexadecanol, 2-octadecanol, 4-eicosanol, and 5-eicosanol having an HLB within the preferred range arc useful viscosity/dispersibility modifiers in the context of the present invention. Examples of ethoxylated secondary alcohols useful herein as the viscosity/dispersibility modifiers of the compositions include but arc not limited to: 2-$C_{16}$ EO(11); 2-$C_{20}$EO(11); and 2-$C_{16}$EO(14).

(iii) Alkyl Phenol Alkoxylates

As is the case of the alcohol alkoxylates, the hexa-through octadeca-ethoxylates of alkylated phenols, particularly monohydric alkylphenols, having an HLB within the preferred range are useful as the viscosity/dispersibility modifiers. The hexa-through octadeca-ethoxylates of p-tridecylphenol, m-pentadecylphenol, and the like, are useful herein. Preferred examples of ethoxylated alkylphenols useful as the viscosity/dispersibility modifiers include but are not limited to: p-tridecylphenol EO(11) and p-pentadecylphenol EO(18).

It is generally recognized by one of ordinary skill in the art that a phenyl group in the nonionic formula is the equivalent of an alkylene group containing from 2 to 4 carbon atoms. For the present purpose, nonionic surfactants containing a phenylene group arc considered to contain an equivalent number of carbon atoms calculated as the sum of the carbon atoms in the alkyl group plus about 3.3 carbon atoms for each phenylene group.

(iv) Olefinic Alkoxylates

The alkenyl alcohols, both primary and secondary, and alkenyl phenols corresponding to those disclosed hereinabove can be ethoxylated to an HLB within the range recited herein and used as the viscosity/dispersibility modifiers in the compositions of the present invention.

(v) Branched Chain Alkoxylates

Branched chain primary and secondary alcohols which are available from the well-known "OXO" process can be ethoxylated and employed as the viscosity/dispersibility modifiers in the present compositions.

The ethoxylated nonionic surfactants summarized hereinabove can be usefully employed in the present compositions either alone or in specific mixtures.

(3) Amine Oxides

Suitable amine oxides include, but are not limited to: those with one alkyl or hydroxyalkyl moiety of about 8 to about 28 carbon atoms, preferably from about 8 to about 16 carbon atoms, and two alkyl moieties selected from the group consisting of alkyl groups and hydroxyalkyl groups with about 1 to about 3 carbon atoms. Amine oxides, if employed, are generally present in solid compositions at a level of from 0% to about 15%, preferably from about 3% to about 15%; and in liquid compositions at a level of from 0% to about 5%, preferably from about 0.25% to about 2%. The total amount amine oxide is generally present in an amount effective to provide a stable composition.

Preferred examples of amine oxides employable in the present invention include, but are not limited to: dimethyloctylamine oxide, diethyldecylamine oxide, bis-(2-hydroxyethyl)dodecylamine oxide, dimethyl dodecylamine oxide, dipropyltetradecylamine oxide, methylethylhexadecylamine oxide, dimethyloctadecylamine oxide, di(2-hydroxyethyl)octyldecylamine oxide and coconut fatty alkyl dimethylamine oxide.

(4) Fatty Acids and/or Alkoxylated Fatty Acids

Suitable fatty acids include those containing from about 12 to about 25, preferably from about 13 to 22, more preferably from about 16 to about 20, total carbon atoms, with the fatty moiety containing from about 10 to about 22, preferably from about 10 to about 18, more preferably from about 10 to about 14 carbon atoms. Fatty acids are typically present at approximately the levels outlined above for amine oxides. Alkoxylated fatty acids prepared by reaction alkylene oxide with the aforementioned fatty acids can also be preferably employed in the compositions of the present invention.

Electrolyte Concentration Aids

Inorganic viscosity control agents that can also act like, or augment the effect of the surfactant concentration aids include: water-soluble, ionizable salts. Such salts can also optionally be incorporated into the fabric softener compositions of the present invention. A wide variety of ionizable salts can be used. Examples of suitable salts include, but are not limited to: the halides of the Group IA and IIA metals of the Periodic Table of Elements, e.g., calcium chloride, magnesium chloride, sodium chloride, potassium bromide, and lithium chloride. The amount of ionizable salts used depends on the amount of active ingredients used in the compositions. Typical levels of salts used to control the composition viscosity are from about 20 to about 20,000 ppm, preferably from about 20 to about 11,000 ppm, by weight of the composition.

Alkylene polyammonium salts can be incorporated into the composition to give viscosity control in addition to, or in place of, the water-soluble, ionizable salts described above. Additionally, these agents can act as scavengers, forming ion pairs with anionic detergent carried over from the main wash to the rinse and may improve softening performance. These agents may stabilize the viscosity over a broader range of temperature, especially at low temperatures, compared to the inorganic electrolytes. Some examples of alkylene polyammonium salts include but are not limited to 1-lysine monohydrochloride and 1,5-diammonium-2-methylpentane dihydrochloride.

II) Stabilizers

Stabilizers may also be optionally employed in the compositions of the present invention. The term "stabilizer," as used herein, includes antioxidants and reductive agents. These agents arc typically present at levels of from 0% to about 2%, preferably from about 0.01% to about 0.2%, more preferably from about 0.05% to about 0.1% for antioxidants and more preferably from about 0.01% to about 0.2% for reductive agents. The stabilizers provide good odor stability under long term storage conditions. Examples of antioxidants which can be employed in the compositions of the present invention include, but are not limited to: a mixture of ascorbic acid, ascorbic palmitate, and propyl gallate; a mixture of BHT (butylated hydroxytoluene), BHA (butylated hydroxyanisole), propyl gallate, and citric acid; butylated hydroxytoluene; tertiary butylhydroquinone; natural tocopherols; and butylated hydroxyanisole; long chain esters. ($C_8$–$C_{22}$) of gallic acid such as dodecyl gallate; and the like.

Examples of reductive agents include, but are not limited to; sodium borohydride, sodium bisulfite, hypophosphorous acid, and mixtures thereof.

Additional Optional Ingredients

Soil Release Agent

The fabric softener composition of the present invention may optionally contain from 0.1% to 10%, preferably from 0.2% to 5%, of a soil release agent. Preferably, the soil release agent is a polymeric soil release agent such as one which contains copolymeric blocks of terephthalate and polyethylene oxide or polypropylene oxide, cationic guar gums, and the like. U.S. Pat. No. 4,956,447, which is incorporated herein by reference, discloses some preferred soil release agents comprising cationic functionalities.

Cellulosic derivatives are also functional as soil release agents. Examples of such agents include, but are not limited to: hydroxyethers of cellulose, methyl cellulose, hydroxypropyl methylcellulose, hydroxybutyl methylcellulose, or mixtures thereof wherein said cellulosic polymer has a viscosity in a 2% aqueous solution at 20° C. of 15 to 75,000 centipose. Other effective soil release agents arc cationic guar gums.

Bacteriocides

Examples of bacteriocides which can be employed in the compositions of the present invention include, but are not limited to: parabens such as methyl, glutaraldehyde. formaldehyde, 2-bromo-2-nitropropane-1,3-diol, and a mixture of 5-chloro-2-methyl-4-isothiazoline-3-one and 2-methyl-4-isothiazoline-3-one. Typical levels of bacteriocides used in the present compositions are about 1 ppm to about 2,000 ppm by weight of the composition, depending on the type of bacteriocide selected.

Silicones

Dimethylpolysiloxane (silicone) or modified silicone can be added to the composition of this present invention, in order to enhance the softening property and waterabsorbency of the unsaturated quaternary ammonium salt of formula (I)–(III). Dimethypolysiloxane or a modified silicone, having a viscosity of 20–10000 cps at 25° C., is preferred.

Modified silicones useful in the present invention include, for example, polyoxyethylene modified silicone and amino-modified silicone, wherein the amount of the modification is preferably less than 10%.

It is preferable that dimethylpolysiloxane or modified silicones are emulsified with a polyoxyethylene-type nonionic surfactant or a monoalkylcationic-type or dialkylcationic-type cationic surfactant prior to their use.

Other Optional Components

The present invention can include other optional components conventionally used in textile treatment compositions, for example, colorants, preservatives, optical brighteners, opacifiers, fabric conditioning agents, surfactants, stabilizers such as guar gum, anti-shrinkage agents, anti-wrinkle agents, fabric crisping agents, anti-spotting agents, fungicides, anti-corrosion agents, antifoam agents, and the like.

An optional additional softening agent of the present invention is a nonionic fabric softener material. Typically, such nonionic fabric softener materials have an HLB of from about 2 to about 9, more typically from about 3 to about 7. The foregoing nonionic fabric softener materials tend to be readily dispersed either by themselves, or when combined with other materials such as a single-long-chain alkyl cationic surfactant, the materials as set forth hereinafter, use of hotter water, and/or with more agitation. In general, the materials selected should be relatively crystalline, higher melting, (e.g., 50° C. or greater) and relatively water-insoluble.

The level of optional nonionic softener in the solid composition is typically from about 10% to about 40%, and preferably from about 15% to about 30%. The level of optional nonionic softener in the liquid composition is typically from about 0.5% to about 10%, preferably from about 1% to about 5%. Preferred nonionic softeners are fatty acid partial esters of polyhydric alcohols, or anhydrides thereof, wherein the alcohol, or anhydride, contains from 2 to about 18, preferably from 2 to about 8, carbon atoms, and each fatty acid moiety contains from about 12 to about 30, preferably from about 16 to about 20 carbon atoms. Typically, such softeners contain from about one to about 3, preferably about 2 fatty acid groups per molecule.

The polyhydric alcohol portion of the ester can be ethylene glycol, glycerol, poly (e.g., di-, tri-, tetra, penta-, and/or hexa-) glycerol, xylitol, sucrose, erythritol, pentaerythritol, sorbitol or sorbitan. Sorbitan esters and polyglycerol monostearate are particularly preferred. The fatty acid portion of the ester is normally derived from fatty acids having from about 12 to about 30, preferably from about 16 to about 20 carbon atoms, typical examples of said fatty acids being lauric acid, myristic acid, palmitic acid, stearic acid and behenic acid.

Examples of sorbitan esters that maybe employed in the softening composition of the present invention include: sorbitan monolaurate, sorbitan monomyristate, sorbitan monopalmitate, sorbitan monobehenate, sorbitan monooleate, sorbitan dilaurate, sorbitan dimyristate, sorbitan dipalmitate, sorbitan distearate, sorbitan dibehenate, sorbitan dioleate, and mixtures thereof, and mixed tallowalkyl sorbitan mono- and di-esters. Such mixtures are readily prepared by reacting the foregoing hydroxy-substituted sorbitans, particularly the 1,4 and 1,5-sorbitans, with the corresponding acid or acid chloride in a simple esterification reaction. It is to be recognized, of course, that commercial materials prepared in this manner will comprise mixtures usually containing minor proportions of uncyclized sorbitol, fatty acids, polymers, isosorbide structures, and the like.

The following examples are provided to illustrate the fabric softener composition of the present invention as well as some advantages that can be obtained therefrom.

EXAMPLE 1

This example shows that the use of high mono alkyl in the MDEA ester quat, i.e., MDEA ester quat with a high content of monoester, enables the TEA ester quat to be formulated to higher solids that has high softening properties. This example also shows that a blend of standard MDEA ester quat (low monoester or low mono alkyl) with standard TEA ester quat results in a blended product that performs less effectively than pure MDEA ester quat and better than standard TEA ester quat. This data shows what one would expect with performance being more of an additive effect of the two softeners being blended. The data for the compositions of the present invention, on the other hand, illustrate a true synergism that is not additive.

The softening effectiveness of a formulation in this example was determined by judging the softness of cotton hand towels washed in an identical manner and rinsed with a known amount of softener formulation present. A panel was used to rank the towels by softness (1 for worst, 2 for second worst, etc. up to the number of formulations being ranked) with no ties being allowed. The total of each formulation's ranks is computed and statistical analysis (Freidman Simple Rank Test) was used to determine if a statistical difference at 95% confidence level existed between the formulations.

The results of the simple ranking test are provided in a shorthand form. In particular, the softness is listed in the order of their total rank number and preceded by a letter or letters. If two softeners share a common letter they are statistically equal. Formulations that do not share a letter were judged to be statistically different and the formulation listed first was superior in softening. The number following the @ represents the dosage of the softener actives/dry weight of fabric laundry being treated and this result multiplies by 100%. Typical, North American Washing conditions were employed in this example.

Samples of MDEA ester quat and TEA ester quat (prior art) made from 20 IV raw materials were compared to the normal versions and the following was observed:

A MDEA ester quat @ 0.2

A MDEA ester quat 20 IV @ 0.2

B TEA ester quat @ 0.2

B TEA ester quat 20 IV @ 0.2

The foregoing data illustrates that MDEA ester quat was statistically better than TEA ester quat.

High mono (26%) MDEA ester quat (prior art) was compared to Commercial Brand MDEA ester quat, Commercial Brand Softener B and Commercial Brand Softener C and the following results were observed:

A High Mono MDEA ester quat @ 0.2

A High Mono MDEA ester quat @ 0.175

B Commercial Brand MDEA ester quat @ 0.2

B Commercial Brand Softener B @ 0.2

C Commercial Brand Softener C @ 0.3

The foregoing data demonstrates that high mono MDEA ester quat was statistically superior to Commercial Brand Softeners A, B and C, and statistically superior to commercial brand MDEA ester quat even when used at a lower dosage.

50:50 blends of High mono MDEA ester quat with TEA ester quat of 20 IV and 50 IV were prepared at 25% solids. These samples were compared to Commercial Brand MDEA ester quat at equal volume addition. The results were:

A MDEA/TEA IV 20(1:1) 15 ml

A MDEA/TEA IV 50(1:1) 15 ml

A Commercial Brand MDEA ester quat 15 ml

The above data demonstrates that high mono MDEA ester quat blended with TEA ester quat at a 1:1 ratio can be formulated to high solid levels and is equivalent to Commercial Brand MDEA ester quat on an equal volume basis.

Various TEA ester quats representing different mole ratios of fatty acid to TEA were blended with 50:50 MDEA ester quat with high mono and compared to Commercial Brand MDEA ester quat and the following results were observed:

A High mono MDEA ester quat @ 0.2

B Commercial Brand MDEA ester quat

B,C 1.5 mole ratio FA/TEA @ 0.2

B,C 1.75 mole ratio FA/TEA @ 0.2

C 2.25 mole ratio FA/TEA @ 0.2

High mono MDEA ester quat was statistically superior to Commercial Brand MDEA ester quat. Low mole ratio fatty acid to TEA was preferred and such blends were equivalent to Commercial Brand MDEA ester quat.

The MDEA ester quat with high mono used in the above experiments had an IV of 20. A new sample of high mono MDEA ester quat having an IV of 50 was used in the following experiments. Blends with TEA ester quat were tested against Commercial Brand MDEA ester quat and the following was observed:

A MDEA ester quat high mono (IV 50) @ 0.2

A,B MDEA ester quat high mono (IV 50)/TEA ester quat (3:1) @ 0.2

B MDEA ester quat high mono (IV) 50/TEA ester quat (1:1) @ 0.2

B Commercial Brand MDEA ester quat @ 1.2

High mono (IV 50) MDEA ester quat performed statistically better than Commercial Brand ester quat. TEA ester quat blends are better, but not statistically better than Commercial Brand MDEA ester quat.

A 50:50 blend of high mono MDEA ester quat and TEA ester quat with a 1.6 FA/TEA ratio was compared to Commercial Brand ester quat, a 50:50 blend of regular TEA ester quat with high mono MDEA ester quat, and a 3:1 blend of high mono MDEA and ADOGEN® 470 (a di tallow dimethyl ammonium chloride supplied by Goldschmidt Chemical Corporation) and the following was observed:

A 3:1 blend MDEA ester quat high mono/ADOGEN® 470 @ 0.2

B High mono MDEA ester quat/1.6FA/TEA ratio ester quat (1:1) @ 0.2

B High mono MDEA ester quat/regular TEA ester quat (1:1) @ 0.2

B Commercial Brand MDEA ester quat @ 0.2

The aforementioned results indicate that the high mono MDEA ester (quit blend with ADOGEN® 470 maintained superiority over Commercial Brand MDEA ester quat. Blends of high mono MDEA ester quat with TEA ester quat were equivalent to Commercial Brand MDEA ester quat.

EXAMPLE 2

This example shows the importance of providing a blend of MDEA ester and TEA ester that is made from the individual prepared quats. It is important that the MDEA ester quat be made in such a way as to maximize production of the mono alkyl, i.e., monoester, quat. German Patent No. 19642 038 C1 teaches that a blend of MDEA and TEA quats can he made from blending the polyamines before esterification and quaternization. Manufacturing quats in this manner does not allow the controlled production of high mono MDEA, which is key to the blends of the present invention.

A quat made from the disclosure of the German patent containing 15% MDEA and 85% TEA was made and was compared to a composition with same ratio or MDEA (high mono alkyl) to TEA made by blending the individual quats and a quat using a higher ratio of MDEA (high mono alkyl) to TEA. National brand "B" was used as a control. The softness of each composition was determined and the results of this testing is as follows:

| Formulation | Score |
|---|---|
| National Brand "B" | A |
| MDEA high monoalkyl/TEA ester quat (70:30)-Invention | A |
| MDEA high monoalkyl/TEA ester quat (15:85)-Comparative sample | B |
| MDEA/TEA ester quat (15:85) prepared in accordance with DE 196 42 038 C1 | B |

The softener blend typically of the present application was statistically superior to the blend taught in German patent.

German Patent No. 196 42 038 C1 also teaches that the quat made by blending the polyamines before esterification and quaternization was superior in forming high solids "ultra" softener formulations. One of the requirements for a successful "ultra" formulation is a low and stable viscosity. Formulations containing 10, 15, 20% active softener from the teachings of the German patent were compared to formulations containing the same TEA to MDEA ratios of the separate quats. A formulation containing 10% active softener composition as disclosed in this application was included for comparison. Viscosity measurements (Brookfield DV 1 using spindle #2) were made immediately after formulation (time 0) as well as 24 and 48 hours later. Calcium chloride was used at 0.8% level in all formulations.

| Formulation | Viscosity at time 0 (cps) | Viscosity at 24 hours (cps) | Viscosity at 48 hours (cps) |
|---|---|---|---|
| German Patent Example at 10% solids | 51 | 85 | 75 |
| German Patent Example at 15% solids | 73 | 480 | 850 |
| German Patent Example at 20% solids | 52 | 750 | 1500 |
| MDEA/TEA (15:85) 10% solids | 42 | 45 | 45 |
| MDEA/TEA (15:85) 15% solids | 60 | 69 | 69 |

-continued

| Formulation | Viscosity at time 0 (cps) | Viscosity at 24 hours (cps) | Viscosity at 48 hours (cps) |
|---|---|---|---|
| MDEA/TEA (15:85) 20% solids | 120 | 135 | 145 |
| MDEA/TEA (70:30) 10% solids | 12 | 14.5 | 14.3 |

This data shows that the softener of the German patent thickness on sitting especially at the higher solids levels. The individual quats blended to the same ratio are thin and stable when formulated to the same solids level. The blend typical of the present application also showed low and stable viscosity.

While the present invention has been particularly shown and described with respect to preferred embodiments thereof, it will be understood by those skilled in the art that the foregoing and other changes in forms and details may be made without departing from the spirit and scope of the present invention. It is therefore intended that the present invention not be limited to the exact forms and details described and illustrated, but fall within the scope of the appended claims.

What is claimed is:

1. A fabric softener composition comprising a blend of from about 15 to about 65%, by weight of the total blend, of a triethanol amine ester quat and from about 35 to about 85%, by weight of the total blend, of a methyl diethanol amine ester quat, said methyl diethanol amine ester quat having a mono alkyl ester quat level of about 10% or greater.

2. The fabric softener composition of claim 1 wherein the blend comprises from about 25 to about 50% by weight of the triethanol amine ester quat and from about 50 to about 75% by weight of the methyl diethanol amine ester quat.

3. The fabric softener composition of claim 1 wherein the blend comprises from about 30 to about 45% by weight of the triethanol amine ester quat and from about 55 to about 70% by weight of the methyl diethanol amine ester quat.

4. The fabric softener composition of claim 1 wherein the blend comprises from about 35 to about 40% by weight of the triethanol amine ester quat and from about 60 to about 65% by weight of the methyl diethanol amine ester quat.

5. The fabric softener composition of claim 1 wherein the mono alkyl ester quat level is from about 15 to about 50%.

6. The fabric softener composition of claim 1 wherein the triethanol amine ester quat has the structural formula

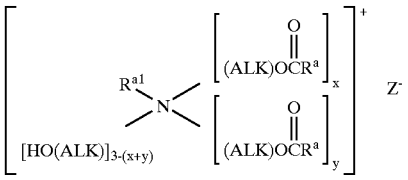

wherein each $R^a$ is individually selected from the group consisting of straight or branched chain, optionally substituted alkyl groups having from 11 to 23 carbon atoms; $R^{a1}$ is a $C_1$–$C_4$ straight or branched alkyl or a $C_7$–$C_{10}$ aralkyl; ALK is an alkylene having from 2 to about 6 carbon atoms; $Z^-$ is a softener compatible anion; and x+y=1.2 to 2.5.

7. The fabric softener composition of claim 6 wherein $R^a$ is individually selected from die group consisting of straight or branched chain, optionally substituted alkyl groups having from 11–21 carbon atoms; $R^{a1}$ is methyl; and ALK is $C_2H_4$.

8. The fabric softener composition of claim 1 wherein the methyl diethanol amine ester quat has the following structural formula:

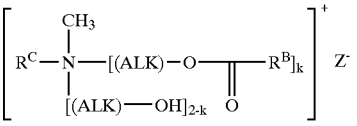

wherein $R^B$ is individually selected from the group consisting of straight or branched chain, optionally substituted alkyl groups having from 11 to 23 carbon atoms; ALK is an alkylene having from 2 to about 6 carbon atoms; k=1.2 to 1.7; $R^c$ is a $C_1$–$C_4$ alkyl or a $C_7$–$C_{10}$ aralkyl; and $Z^-$ is a softener compatible anion.

9. The fabric softener composition of claim 8 wherein $R^B$ is individually selected from the group consisting of straight or branched chain, optionally substituted alkyl groups having from 11–21 carbon atoms; ALK is $C_2H_4$; and $R^c$ is methyl.

10. The fabric softener composition of claim 1 further comprising a solvent.

11. The fabric softener composition of claim 1 further comprising other quaternary ammonium compounds.

12. The fabric softener composition of claim 1 wherein said triethanol amine ester quat and said diethanol amine ester quats are prepared from a triglyceride of fatty acid based product that may be optionally partially or fully hydrogenated.

13. A liquid fabric softener composition comprising:

a blend of from about 15 to about 65%, by weight of the total blend, of a triethanol amine ester quat and from about 35 to about 85%, by weight of the total blend, of a methyl diethanol amine ester quat, said methyl diethanol amine ester quat having a mono alkyl ester quat level of about 10% or greater; and water.

14. The liquid fabric softener composition of claim 13 wherein the composition comprises from about 250 to about 5000 ml water added to 100 grams of the blend.

15. The liquid fabric softener composition of claim 13 wherein the blend comprises from about 25 to about 50% by weight of the triethanol amine ester quat and from about 50 to about 75% by weight of the methyl diethanol amine quat.

16. The liquid fabric softener composition of claim 13 wherein the blend comprises from about 30 to about 45% by weight of the triethanol amine ester quat and from about 55 to about 70% by weight of the methyl diethanol amine ester quat.

17. The liquid fabric softener composition of claim 13 wherein the blend comprises from about 35 to about 40% by weight of the triethanol amine ester quat and from about 60 to about 65% by weight of the methyl diethanol amine ester quat.

18. The liquid fabric softener composition of claim 13 wherein the mono alkyl ester quat level is from about 15 to about 50%.

19. The liquid fabric softener composition of claim 13 wherein the triethanol amine ester quat has the structural formula

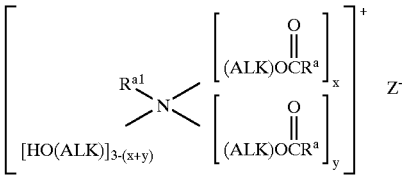

wherein each $R^a$ is individually selected from the group consisting of straight or branched chain, optionally substituted alkyl groups having from 11 to 23 carbon atoms;

$R^{a1}$ is a $C_1$–$C_4$ straight or branched alkyl or $C_7$–$C_{10}$ aralkyl; ALK is an alkylene having from 2 to about 6 carbon atoms; $Z^-$ is a softener compatible anion; and x+y=1.2 to 2.5.

20. The liquid fabric softener composition of claim 19 wherein $R^a$ is individually selected from the group consisting of straight or branched chain, optionally substituted alkyl groups having from 11–21 carbon atoms; $R^{a1}$ is methyl; and ALK is $C_2H_4$.

21. The liquid fabric softener composition of claim 13 wherein the methyl diethanol amine ester quat has the following structural formula:

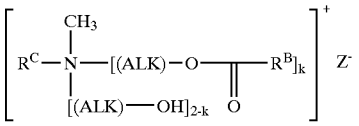

wherein $R^B$ is individually selected from the group consisting of straight or branched chain, optionally substituted alkyl groups having from 11 to 23 carbon atoms; ALK is an alkylene having from 2 to about 6 carbon atoms; k=1.2 to 1.7; $R^c$ is a $C_1$–$C_4$ alkyl or a $C_7$–$C_{10}$ aralkyl; and $Z^-$ is a softener compatible anion.

22. The liquid fabric softener composition of claim 21 wherein $R^B$ is individually selected from the group consisting of straight or branched chain, optionally substituted alkyl groups having from 11–21 carbon atoms; ALK is $C_2H_4$; and $R^c$ is methyl.

23. The liquid fabric softener composition of claim 13 further comprising other quaternary ammonium compounds.

24. The liquid fabric softener composition of claim 13 wherein said triethanol amine ester quat and said diethanol amine ester quats are prepared from a triglyceride of a fatty acid based product that may be optionally partially or fully hydrogenated.

* * * * *